US009617842B2

(12) United States Patent
Johnson et al.

(10) Patent No.: US 9,617,842 B2
(45) Date of Patent: Apr. 11, 2017

(54) METHOD OF COMPLETING A WELL

(71) Applicants: Michael Johnson, Katy, TX (US); Thomas Jones, Cypress, TX (US); Randal F. LaFollette, Conroe, TX (US); D. V. Satyanarayana Gupta, The Woodlands, TX (US); Andrew K. Jordan, Magnolia, TX (US)

(72) Inventors: Michael Johnson, Katy, TX (US); Thomas Jones, Cypress, TX (US); Randal F. LaFollette, Conroe, TX (US); D. V. Satyanarayana Gupta, The Woodlands, TX (US); Andrew K. Jordan, Magnolia, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/619,706

(22) Filed: Feb. 11, 2015

(65) Prior Publication Data

US 2015/0369024 A1 Dec. 24, 2015

Related U.S. Application Data

(60) Provisional application No. 62/013,661, filed on Jun. 18, 2014.

(51) Int. Cl.

| | |
|---|---|
| ***G01V 3/08*** | (2006.01) |
| ***E21B 43/16*** | (2006.01) |
| ***E21B 43/26*** | (2006.01) |
| *E21B 34/00* | (2006.01) |

(52) U.S. Cl.
CPC ..... *E21B 43/26* (2013.01); *E21B 2034/007* (2013.01)

(58) Field of Classification Search
CPC ..... E21B 43/16
USPC ..... 324/338; 166/268
See application file for complete search history.

(56) References Cited

U.S. PATENT DOCUMENTS

| | | | | |
|---|---|---|---|---|
| 4,423,781 | A | 1/1984 | Thomas | |
| 4,453,598 | A | 6/1984 | Singer et al. | |
| 7,257,955 | B2 | 8/2007 | Lifson et al. | |
| 7,874,365 | B2 * | 1/2011 | East et al. | 166/305.1 |
| 8,415,279 | B2 | 4/2013 | Quintero et al. | |
| 2003/0075326 | A1 | 4/2003 | Ebinger | |
| 2006/0070740 | A1 | 4/2006 | Surjaatmadja et al. | |
| 2006/0096758 | A1 | 5/2006 | Berry et al. | |
| 2006/0137876 | A1 * | 6/2006 | Santra et al. | 166/291 |
| 2007/0135314 | A1 * | 6/2007 | Frenier et al. | 507/260 |
| 2009/0283280 | A1 * | 11/2009 | Themig | 166/387 |
| 2011/0005310 | A1 * | 1/2011 | Lunkad et al. | 73/152.18 |
| 2014/0190696 | A1 * | 7/2014 | Iverson et al. | 166/293 |
| 2014/0290958 | A1 * | 10/2014 | Marr et al. | 166/311 |

* cited by examiner

*Primary Examiner* — Bot Ledynh
(74) *Attorney, Agent, or Firm* — Cantor Colburn LLP

(57) ABSTRACT

A method of completing a well includes, pumping treating fluid into a tool string in the well, displacing drilling mud within the tool string with the treating fluid, and treating an earth formation with the treating fluid.

23 Claims, 3 Drawing Sheets

METHOD OF COMPLETING A WELL

BACKGROUND

Drilling muds are employed when drilling boreholes into earth formations such as in the hydrocarbon recovery and carbon dioxide sequestration industries, for example. The muds have specific properties such as viscosity, density, and gelled characteristics that aid the drilling operation. These same properties however, are undesirable for use during other aspects of a well completion operation. As such, the mud is typically recovered to surface and replaced with other fluids that have properties better suited for other operations such as, treating the formation via fracturing and acidizing, for example. This method of replacing the mud serves the purpose for which it is employed; however operators are always interested in methods that may improve efficiency of their operations.

BRIEF DESCRIPTION

Disclosed herein is a method of completing a well. The method includes, pumping treating fluid into a tool string in the well, displacing drilling mud within the tool string with the treating fluid, and treating an earth formation with the treating fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
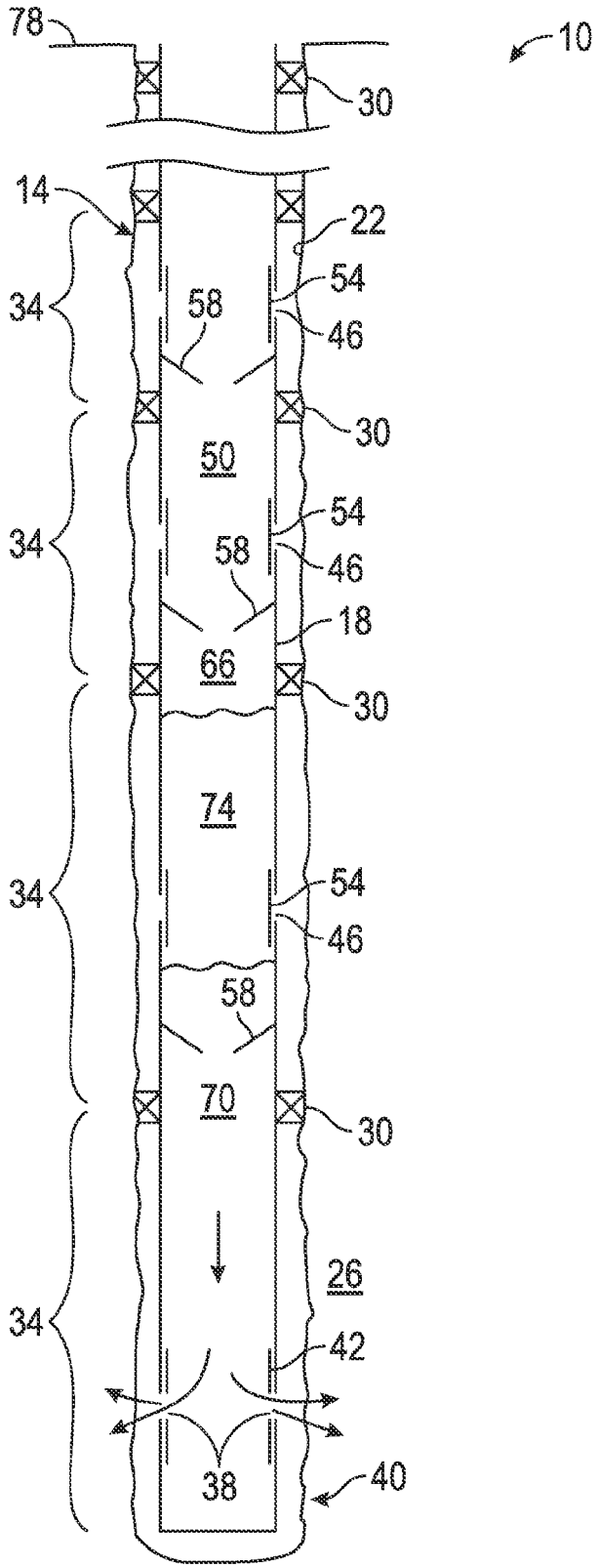
FIG. 1 depicts a cross sectioned schematic view of a well completion system disclose herein.
Figure 2:
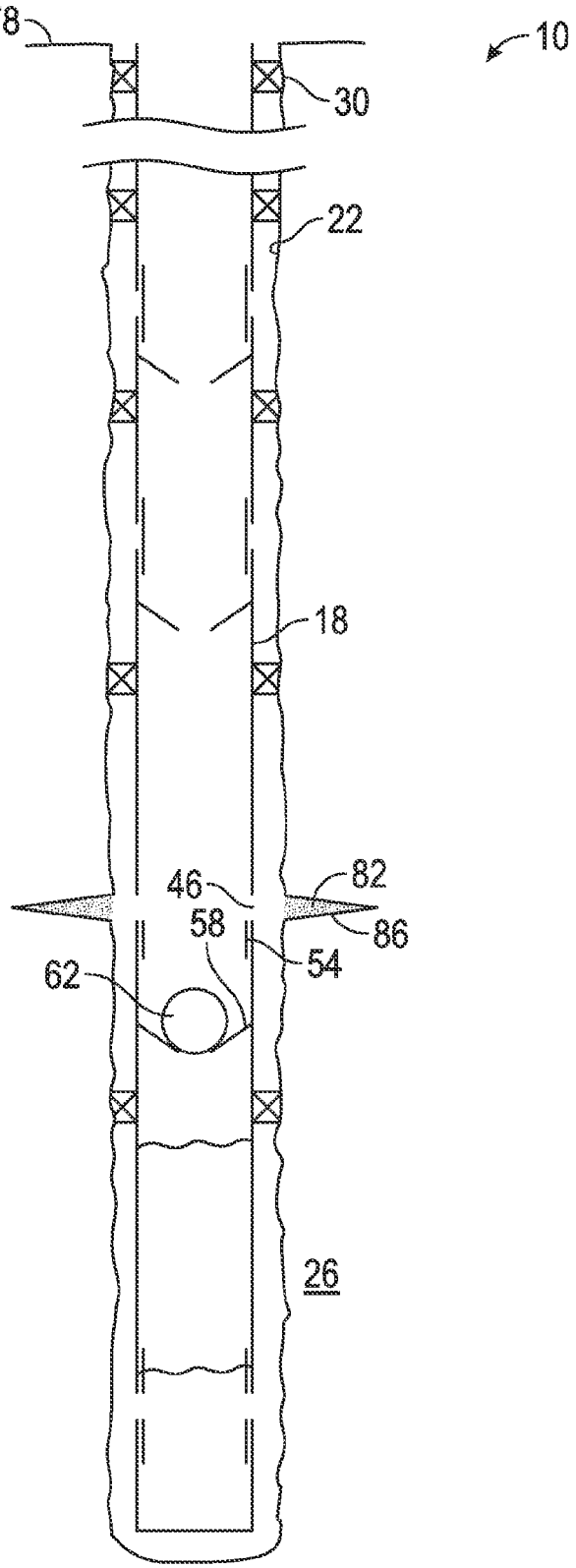
FIG. 2 depicts a cross sectioned schematic view of the well completion system of FIG. 1 in an alternate configuration.
Figure 3:
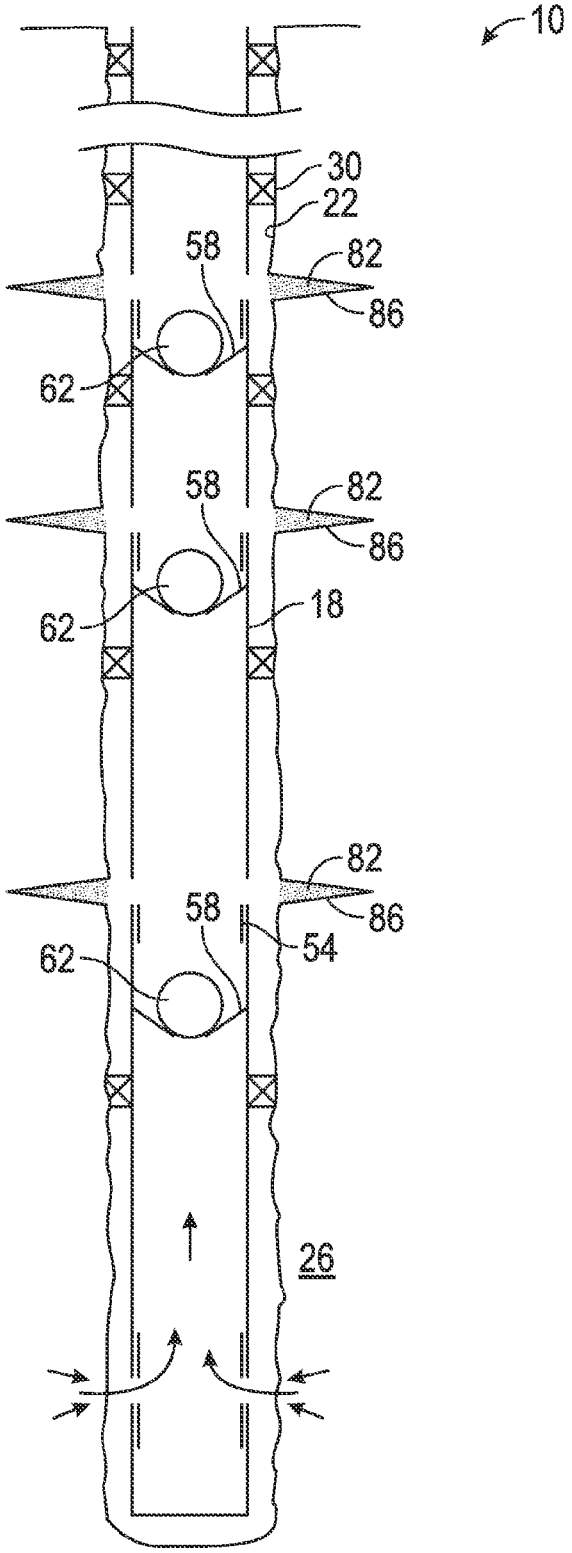
FIG. 3 depicts a cross sectioned schematic view of the well completion system of FIG. 1 in another alternate configuration.

Referring to FIGS. 1-3, an embodiment of a well completion system for carrying out methods of completing a well disclosed herein is illustrated generally at 10. The embodiment of the system 10 illustrated includes a well 14 with a tool string 18 such as a casing or liner, for example, within a borehole 22 in an earth formation 26. Packers 30 in one embodiment define and separate zones 34 of the earth formation 26. Openings 38 in the tool string 18 near a bottom 40 (in vertical wells) or near a toe (in deviated or horizontal wells) may be occluded by a sleeve 42 or open to flow therethrough depending upon a position of the sleeve 42 relative to the openings 38. In one embodiment ports 46 such as treating ports or fracturing ports, for example, are openable to provide fluidic communication between the zones 34 and an inside 50 of the tool string 18 by movement of collars 54 relative to the ports 46. The ports 46 are also closable responsive to movement of the collars 54. Seats 58 positioned near the ports 46 in one embodiment can be plugged by a plug 62 (FIGS. 2 and 3 only), such as a ball or dart, for example, seated thereagainst. In an embodiment the collars 54 can be moved in response to pressure built against a plugged one of the seats 58 or by other mechanisms such as control lines or shifting tools (not shown). Additionally, the plug 62 can be instrumented as desired for such things as pressure and temperature, for example, to better understand conditions within the well 14 during treatment and after retrieval thereof.

The foregoing well completion system 10 allows an operator to complete a well as described hereunder. Treating fluid 66 can be pumped into the tool string 18 to displace drilling mud 70 already present in the tool string 18. The mud 70 can be forced through the openings 38 when the openings 38 are not covered by the sleeve 42. The sleeve 42 can be moved to uncover the openings 38 by pressure built within the tool string 18 or by other means, including a shifting tool or control line (not shown), for example. The mud 70 forced through the openings 38 can flow into an inefficient or nonproducing zone 34 of the earth formation 26. A spacer 74 such as a physical wiper and/or a fluidic separation, for example (note the illustrated embodiment is a fluidic separation) can be positioned between the treating fluid 66 and the mud 70 to decrease mixing of these disparate fluids. Embodiments may include chemicals such as surfactants in the spacer 74 to help clear the mud 70 (and solids such as cuttings contained therein) from within the tool string 18 while the treating fluid 66 is displacing the mud 70. Specialized surfactant blends can help maintain separation between the mud 70 which may be synthetic or oil based, for example, and the treating fluid 66 which may be water based, for example. Examples of such surfactant blends include, weighting agent, viscosifier, nonpolar fluid, and fresh water or brine (e.g. sea water). In a non-restrictive version, the surfactant blend may include an alkyl polyglycoside and a polyglycerol ester, for example. Alternatively, the surfactant package may have an absence of an alkyl polyglycoside. These and additional examples of specialized surfactant blends are disclosed in U.S. Pat. No. 8,415,279 the content of which is incorporated herein by reference in its entirety. The treating fluid 66 also helps to remove filter cake and drilling fluid material, solubilize synthetic or oil residue, water-wet a face of the formation 26 and rock matrix, and carry residual mud particles deeper into the rock matrix. When the spacer 74 is microemulsion-based it not only helps maintain separation between the mud 70 and treating fluid 66, the spacer 74 also cleans everything within the tool string 18 it comes into contact with as it is pumped down hole. Also due to an ultra-low interfacial tension of the microemulsion of the spacer 74, destruction of the synthetic or oil based drilling mud 70 occurs as well as creating a high diffusion rate into the rock matrix, thereby facilitating a more efficient fracture penetration into the formation 26. Forcing the mud 70 into the formation 26 through the openings 38 negates the need to recover and filter the mud 70 at a surface 78 of the well 14, which can be a costly and time consuming process.

The treating fluid 66, once positioned within the tool string 18 can be used to treat the zones 34 of the earth formation 26. Such treatments can include fracturing including pumping proppant 82 into fractures 86 (shown in FIGS. 2 and 3 only) in the earth formation 26 or acidizing the formation 26, for example. The use of the plugs 62 and the seats 58 in one embodiment allows an operator to open the ports 46 to one of the zones 34 at a time and to treat just that particular target zone 34 independently of the other zones 34. This independent control includes sequentially treating the zones 34 working in a direction away from the bottom or toe 40 and proceeding toward the surface 78.

After all the zones 34 have been treated the seats 58, the plugs 62 and any other potentially obstructing items within the tool string 18 can be removed from the tool string 18. In some embodiments this removal can be done via dissolution of the seats 58, the plugs 62 and other items by making them out of dissolvable materials. In other embodiments removal of the seats 58, the plugs 62 and other items may be via drilling or milling, for example. The configuration of the system 10 allows for the drilling mud 70 to be reverse circulated to substantially refill the tool string 18 with the drilling mud 70. Recirculating the mud 70 into the tool string 18 has some advantages over conventional methods. One advantage being a reduction in losses of expensive fluids through the open ports 46 and into the now fractured earth formation 26. The gelled properties of the mud 70 allows the mud 70 to substantially plug the fractures 86 by bridging small gaps between the proppant 82. Additionally, the recirculated mud 70 is very good for carrying the cuttings formed during drilling and milling of the seats 58, the plugs 62 and other items within the tool string 18.

Recirculation of the mud 70 into the tool string 18 in some applications may be difficult to achieve, due to pressure differentials and differences in permeability, for example. Even if recirculating the mud 70 is not difficult it may not be desirable. In such cases, the sleeve 42 may be moved back to a position wherein it occludes flow through the openings 38 to prevent recirculation of the mud 70 into the drill string 18.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of completing a well comprising:

pumping treating fluid into a tool string in the well;

displacing drilling mud within the tool string with the treating fluid; pumping surfactant between the treating fluid and the drilling mud;

and treating an earth formation with the treating fluid.

2. The method of claim 1, further comprising pumping a spacer with the pumping of the treating fluid.

3. The method of claim 1, further comprising separating the treating fluid from the drilling mud with a spacer during the pumping of the treating fluid.

4. The method of claim 1, further comprising opening at least one opening in the tool string near a bottom or toe of the well and forcing the drilling mud through at least one opening and into the earth formation.

5. The method of claim 4, further comprising opening the at least one opening with pressure.

6. The method of claim 4, further comprising closing the at least one opening in the tool string near a bottom or toe of the well.

7. The method of claim 1, further comprising dropping at least one plug into the well.

8. The method of claim 7, further comprising plugging a seat with the at least one plug.

9. The method of claim 1, further comprising opening at least one port in the tool string.

10. The method of claim 9, further comprising establishing fluidic communication between an inside of the tool string and a target zone of the earth formation through the at least one port.

11. The method of claim 10, further comprising treating the target zone.

12. The method of claim 10, further comprising fracturing the target zone.

13. The method of claim 12, further comprising pumping proppant into the target zone.

14. The method of claim 1, further comprising reverse circulating the drilling mud back into the tool string.

15. The method of claim 14, further comprising plugging proppant filled fractures in the earth formation with the reverse circulated drilling mud.

16. The method of claim 15, further comprising limiting fluid loss to the fractured formation with the drilling mud.

17. The method of claim 14, further comprising drilling or milling out any plug and seats within the tool string.

18. The method of claim 17, further comprising circulating cuttings from the well with the drilling mud.

19. The method of claim 1, wherein the drilling mud is oil based.

20. The method of completing a well of claim 1, wherein the treating fluid is water based.

21. The method of claim 1, further comprising forcing the drilling mud into the earth formation.

22. The method of claim 1, further comprising cleaning the tools string of drilling mud with the treating fluid.

23. The method of claim 1, further comprising water wetting a face of the earth formation.

* * * * *